US010676877B2

(12) United States Patent
Dillingham

(10) Patent No.: US 10,676,877 B2
(45) Date of Patent: Jun. 9, 2020

(54) ASPHALT POTHOLE PATCHER WITH ELECTRICALLY HEATED RISER TUBES

(71) Applicant: H. D. Industries, Inc., Jacksonville, TX (US)

(72) Inventor: Harold W. Dillingham, Jacksonville, TX (US)

(73) Assignee: H.D. Industries, Inc., Jacksonville, TX (US)

( * ) Notice: Subject to any disclaimer, the term of this patent is extended or adjusted under 35 U.S.C. 154(b) by 36 days.

(21) Appl. No.: 16/162,987

(22) Filed: Oct. 17, 2018

(65) Prior Publication Data

US 2020/0123714 A1 Apr. 23, 2020

(51) Int. Cl.
*E01C 19/08* (2006.01)
*E01C 23/06* (2006.01)
*E01C 19/12* (2006.01)

(52) U.S. Cl.
CPC ..... *E01C 19/08* (2013.01); *E01C 19/12* (2013.01); *E01C 23/06* (2013.01); *E01C 2301/02* (2013.01)

(58) Field of Classification Search
CPC ..... E01C 19/08; E01C 19/12; E01C 23/06; E01C 2301/02
See application file for complete search history.

(56) References Cited

U.S. PATENT DOCUMENTS 3,577,976 A * 5/1971 Heller ..... B65D 88/745 126/343.5 A
3,622,748 A * 11/1971 Sellers ..... F24H 1/225 392/456
3,625,489 A * 12/1971 Weaver ..... E01C 23/06 366/24
4,192,288 A * 3/1980 Heller ..... C10C 3/12 126/343.5 A
4,196,827 A 4/1980 Leafdale
4,418,682 A * 12/1983 Heller ..... C10C 3/007 126/343.5 A
4,661,684 A * 4/1987 Sellers ..... F24H 1/20 122/14.1
4,695,186 A * 9/1987 King ..... E01C 23/06 126/343.5 A
4,944,632 A * 7/1990 Dillingham ..... E01C 19/08 404/101
5,120,217 A * 6/1992 O'Brien ..... E01C 19/1004 126/343.5 R (Continued)

OTHER PUBLICATIONS

Bergkamp FP5 Flameless Pothole Patcher Brochure, 7 pages, May 2015, copyright Bergkamp Inc., www.bergkampinc.com.

*Primary Examiner* — Abigail A Risic
(74) *Attorney, Agent, or Firm* — Whitaker Chalk Swindle & Schwartz PLLC; Charles Gunter

(57) ABSTRACT

A portable device is shown for transporting asphalt repair materials for use in repairing potholes in asphalt pavements. The device has a body with a hopper compartment for transporting and dispensing asphalt mix materials. A heat transfer oil chamber is located below the hopper compartment and is heated by a primary heat source during normal working hours of the device. A pair of electrically powered electric heat riser tubes extend in a longitudinal direction in a horizontal plane in the hopper compartment above the bottom wall of the compartment for heating the asphalt materials in the hopper compartment during non-working hours.

8 Claims, 6 Drawing Sheets

(56) References Cited

U.S. PATENT DOCUMENTS

| | | | | |
|---|---|---|---|---|
| 5,419,654 | A | 5/1995 | Kleiger | |
| 5,988,935 | A * | 11/1999 | Dillingham | E01C 23/06 404/101 |
| 6,012,870 | A * | 1/2000 | Dillingham | E01C 19/08 404/101 |
| 6,681,761 | B2 | 1/2004 | Dillingham | |
| 7,037,034 | B2 * | 5/2006 | Dillingham | A01C 15/006 404/84.05 |
| 7,264,694 | B2 | 9/2007 | Merrell et al. | |
| 7,458,746 | B1 | 12/2008 | Zimmerman | |
| 8,016,516 | B2 | 9/2011 | Johnson et al. | |
| 9,068,296 | B1 | 6/2015 | Hulicsko et al. | |
| 9,132,570 | B2 | 9/2015 | Trimbom | |
| 9,416,499 | B2 | 8/2016 | Cronin et al. | |
| 9,587,357 | B1 | 3/2017 | Alhalawani | |
| 9,587,358 | B2 | 3/2017 | Roy | |
| 10,260,208 | B1 * | 4/2019 | Dillingham | E01C 23/10 |
| 10,428,470 | B2 * | 10/2019 | Smith | E01C 19/463 |
| 2003/0150443 | A1 * | 8/2003 | Dillingham | E01C 19/08 126/343.5 A |
| 2004/0240939 | A1 | 12/2004 | Hays et al. | |
| 2014/0010592 | A1 * | 1/2014 | Wright | E01C 19/466 404/79 |

* cited by examiner

ASPHALT POTHOLE PATCHER WITH ELECTRICALLY HEATED RISER TUBES

BACKGROUND OF THE INVENTION

1. Field of the Invention

The present invention relates generally to truck and/or trailer mounted portable devices for dispensing pavement repair materials and, specifically, to such a portable device for dispensing repair materials for asphalt pavements.

2. Description of the Prior Art

In the past, as many as three vehicles were sometimes needed to repair openings and potholes in asphalt, concrete and other roadway surfaces. One vehicle provided an air compressor for use with various pneumatic repair tools which were used to dress the hole, crack or cavity to be filled. Another vehicle contained liquid asphalt tack material which would be sprayed into the dressed cavity, and a third vehicle would deliver asphalt mix material to the cavity. The asphalt would then be packed, compacted and leveled by hand to complete the repair.

U.S. Pat. No. 4,196,827, issued Apr. 8, 1980, entitled "Portable Machine For Transporting Heated Asphalt Products For Use In Repair Asphalt Pavement" shows a portable machine which was designed to incorporate all phases of the pavement repair into one mobile unit. The machine has a hopper for transporting asphalt mix, and a reservoir below the hopper having a heat source. The heat source was a propane fueled retort style heater. The reservoir contained liquid asphalt tack material. The heat source is used to heat the liquid tack material, and the tack material is used to heat the asphalt mix in the hopper by heat transfer. Asphalt tack material is also dispensed from the tack material tank by means of spray equipment connected to a discharge valve on the rear of the truck.

U.S. Pat. No. 4,944,632, issued Jul. 31, 1990, entitled "Device For Dispensing Asphalt Repair Materials", assigned to the assignee of the present invention, shows an improved device of the same general type used for transporting asphalt repair materials for use in repairing potholes in asphalt pavements. The device has a body with a hopper compartment for transporting and dispensing asphalt mix materials. A separate tack oil tank is provided with an internal circulation system for maintaining liquid tack oils in an emulsified state. A heat transfer oil tank was located below the hopper compartment and was heated by a retort tube propane burner.

U.S. Pat. No. 5,988,935, issued Nov. 23, 21999, entitled "Asphalt Repair Apparatus With Dry, Heat Source" and U.S. Pat. No. 6,681,761, issued Jan. 27, 2004, entitled "Exhaust Damper System For Asphalt Heating Device", both assigned to the assignee of the present invention show additional improvements in this same basic design of asphalt repair machine. Both of these devices featured a hopper compartment which was heated by a dry radiant heat source which was heated by a propane retort tube burner.

While the above devices represented an advance in the relevant arts at the time, there is also a need in some circumstances for an asphalt repair device of this general type which utilizes some type of off-hours heating source for heating the asphalt hopper compartment of the device during on-working hours. The heat source would not be used during normal working hours when the hopper compartment is heated with its primary heat source.

Further, there exists a need for such a device which can provide supplemental heat to the hopper compartment during non-working hours which provides even and controlled heat to keep the asphalt hot during non-working hours.

There also exists a need for such au asphalt repair device which features a supplemental heat source that safely and effectively heats the asphalt repair materials without hardening, burning or charring such materials during off-hour time periods.

SUMMARY OF THE INVENTION

The portable apparatus of the invention is used to transport heated pavement repair materials for use in repairing roadways and other traffic bearing surfaces. The device includes a body adapted to be mounted on a portable base for transporting the body to a repair site. The body has a hopper compartment with a V-shaped bottom wall for transporting asphalt mix material and a generally V-shaped heating chamber located below the hopper compartment. The V-shaped bottom wall of the hopper compartment defines an upper extent of the heating chamber. An anger or screw conveyor is mounted in the bottom of the hopper compartment for dispensing asphalt mix materials therefrom. An agitator, such as a paddle shaft, is located above the auger in the hopper compartment for agitating the hopper materials.

A primary beat source is associated with the heating chamber for heating the chamber and for transferring heat to the hopper compartment through the hopper bottom wall for heating the hopper compartment during normal working hours of the device. A supplemental heat source is located within the hopper compartment fin heating the hopper compartment during non-working hours. The supplement heat source comprises one or more electric electric heat riser tubes which extend longitudinally within an interior of the hopper compartment and which are selected to provide low density, slow heat to prevent asphalt materials within the hopper compartment from overheating and burning or cooking, or otherwise deteriorating during periods of supplemental heating.

The primary heat source can be any of the conventionally available sources, such as an LP gas heating source, a CNG gas heating source, an electric heating source or a diesel fired heating source.

In one preferred design for the device, the truck mounted hopper compartment has a front wall, a rear wall and opposing side walls, the front and rear walls defining a chamber length therebetween. A pair of electric heat riser tubes are located in a generally horizontal plane which extends between the front and rear walls above the plane of the agitator shaft, the electric heat riser tubes extending generally parallel to one another on either side of the agitator shaft for a majority of the chamber length.

The preferred electric heat riser tubes are tear drop shaped in cross section and are used to contain electric heating rods which are plugged into a 220 volt electric supply outlet located on a control panel of the truck during non-working hours. In one preferred embodiment, the heating rods are 800 watt electric rods which are selected to supply low density, slow heat to the electric heat riser tubes in the range from 250° F. to 275° F. to prevent asphalt materials in the hopper compartment from being overheated. The electric heating rods can be, for example, approximately 96 inches long where the riser tubes themselves are approximately 108 inches long.

In the preferred configuration to be more fully described, the electric heat riser tubes comprise an external plate-like structure with opposing longitudinal sides which diverge from an upper apex downwardly toward a curved bottom region of the heat tubes. The electric heat riser tubes are installed approximately two thirds of the way up an internal height of the hopper compartment and are effective to keep asphalt materials in the hopper compartment hot during non-working hours of the device when plugged into a 220 volt electric supply outlet. The electric heating rods in the riser tubes are preferably provided with a built-in thermocouple.

In one preferred form of the truck mounted device, the V-shaped bottom wall of the hopper compartment forms an upper, uninsulated common wall of the heating chamber, the heating chamber having an insulated bottom wall and insulated side walls. The heating chamber can be a sealed heat transfer oil chamber and the heat transfer oil chamber can be heated by one of the primary heat sources of the device.

A method of repairing a pothole in an asphalt pavement using the previously described device is also shown. A body is provided on a portable base for transporting the body to a repair site. The body is equipped with a hopper compartment with a V-shaped bottom wall for transporting asphalt mix materials and a generally V-shaped heating chamber located below the hopper compartment, the V-shaped bottom wall of the hopper compartment defining an upper extent of the heating chamber. A screw conveyor, as previously described, is mounted in the bottom of the hopper compartment for dispensing asphalt mix materials. A paddle shaft is located above the screw conveyor in the hopper compartment for agitating the hopper materials.

A primary heat source is provided which is associated with the heating chamber for heating the chamber and for transferring heat to the hopper compartment through the hopper bottom wall to maintain the asphalt mix materials in a workable state during normal working hours of the machine. A supplemental heat source, as has been described, is located within the hopper compartment for heating the hopper compartment during nonworking hours. The supplement heat source includes one or more electric electric heat riser tubes which extend longitudinally within an interior of the hopper compartment and which are selected to provide low density heat to prevent asphalt materials within the hopper compartment from overheating and burning or deteriorating during periods of supplemental heating.

The described device is used to dispense asphalt mix materials from the hopper compartment to fill and repair a pothole during normal working hours of the device while being heated by the primary heat source. The primary heat source for the hopper compartment is turned off during non-working hours and the supplemental heat source is turned on and used to heat asphalt materials in the hopper compartment during the non-working hours to keep the asphalt hot.

Additional objects, features and advantages will be apparent from the written description which follows.

DETAILED DESCRIPTION OF THE INVENTION

The present invention provides an improved pothole patcher design which meets the foregoing objectives. The invention described herein and the various features and advantageous details thereof are explained more fully with reference to the non-limiting examples which are illustrated in the accompanying drawing and detailed in the following description. Descriptions of well-known components and processes and manufacturing techniques are omitted so as to not unnecessarily obscure the workings of the invention. The examples used herein are intended merely to facilitate an understanding of ways in which the invention herein may be practiced and to further enable those of skill in the art to practice the invention. Accordingly, the examples should not be construed as limiting the scope of the claimed invention.

The advantages of present invention can perhaps best be understood with reference to Applicant's prior art device which utilized a propane retort heater system as a "primary heat source" for the asphalt materials which were to be dispensed. By "primary heat source" is meant the heat source that is normally used to heat the asphalt materials in the hopper compartment during normal working hours that the device is in service repairing potholes on a roadway, for example. Accordingly, turning to FIG. 6, the prior art asphalt dispensing apparatus 101 includes a body 103 which is adapted to be mounted on a portable base, such as a truck or trailer. The body has a hopper compartment 105 (FIGS. 6 and 7) with a V-shaped bottom wall 107 for transporting asphalt mix materials. In this discussion, "asphalt mix" materials will be taken to mean pre-mix or aggregate hot or cold mix asphalt and asphalt aggregate. The term "liquid asphalt emulsion" or "tack oil" will be taken to mean asphaltic cements, liquid asphalts, and asphalt emulsions of the type carried in a separate tack oil tank.

Figure 7:
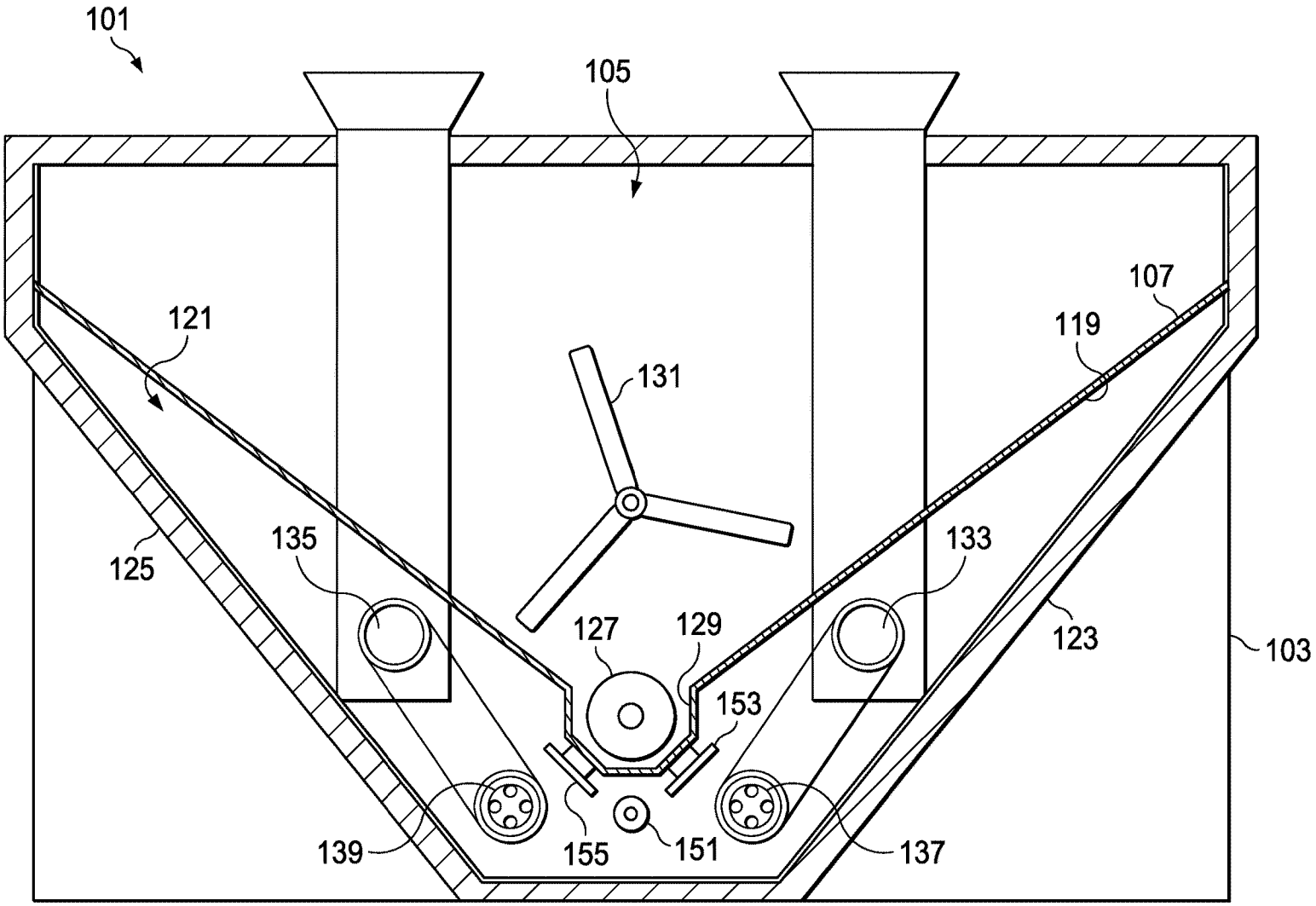
FIG. 7 (PRIOR ART)
FIG. 7 is an end view, partly in section, of the prior art device of FIG. 6.

As best seen in FIG. 7, the V-shaped bottom wall of the hopper compartment forms an upper, uninsulated common wall 119 of a V-shaped heating chamber 121. The V-shaped heating chamber 121 is thus located below the hopper compartment 105 with the V-shaped bottom wall of the hopper compartment defining an upper extent of the heating chamber 121. The heating chamber also has oppositely extending, insulated bottom wall portions 123, 125, as shown in FIG. 7.

Figure 6:
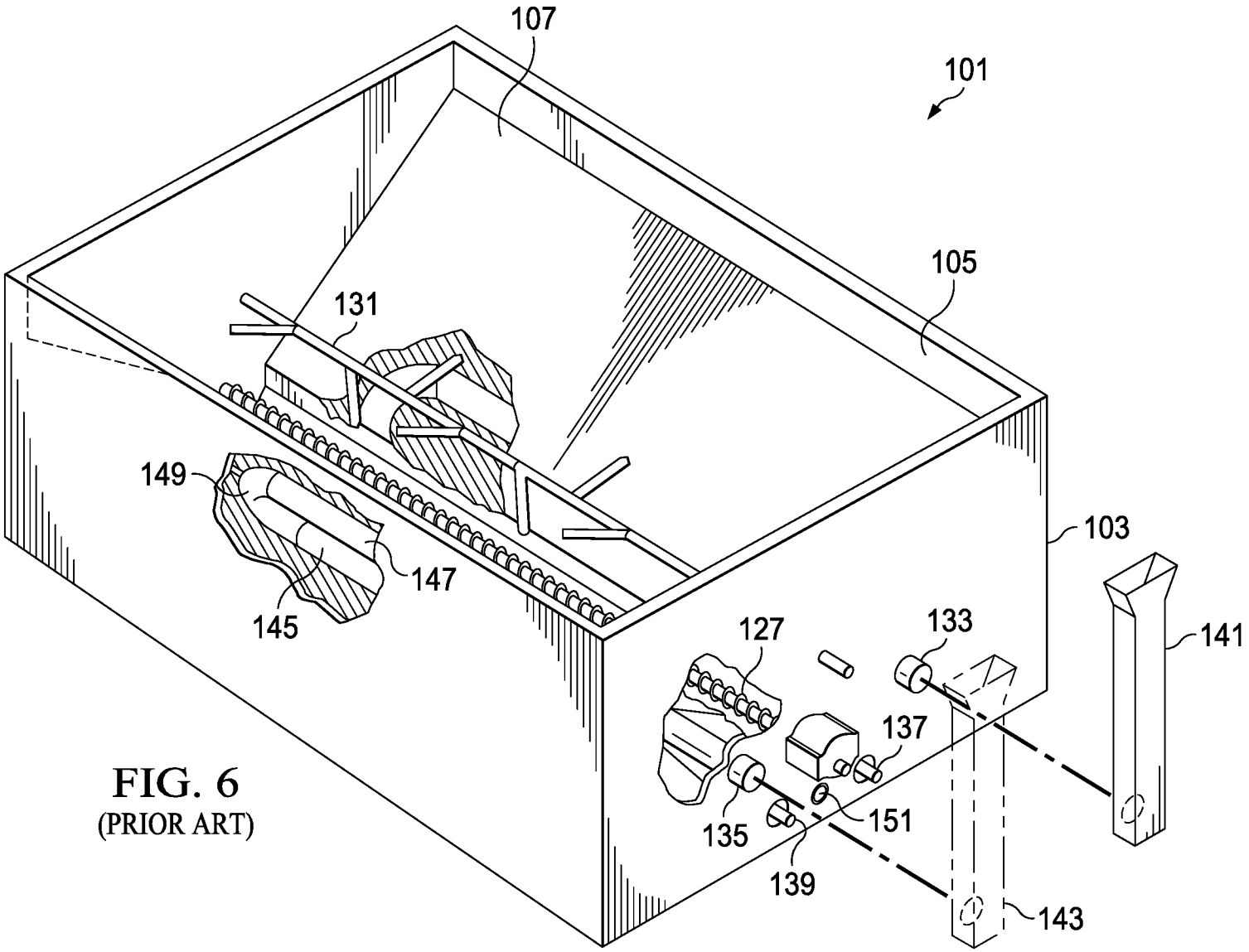
FIG. 6 (PRIOR ART)
FIG. 6 is perspective view, similar to FIG. 1, of a prior art asphalt dispending body, showing an alternative primary heat source for the hopper compartment.

As shown in FIGS. 6 and 7, the body 103 of the portable device is also equipped with an auger or screw conveyor 127 which is mounted in the bottom region 129 of the hopper which forms a trough-like opening extending longitudinally along the bottom wall thereof. The screw conveyor 127 is used to dispense asphalt mix materials contained within the hopper. An agitator means, such as paddle shaft 131 is located above the screw conveyor 127 in the hopper compartment 105 for agitating the hopper materials contained therein.

In the case of the prior art device shown in FIGS. 6 and 7, the "primary heat source" comprises a dry heat means which is associated with the heating chamber 121 for heating the chamber and for transferring heat to the hopper compartment 105 through the hopper bottom wall 119 to maintain the asphalt mix materials contained therein in a workable state. In the prior art device, the dry heat means comprised a pair of oppositely arranged retort tubes 133, 135 which are located within the heating chamber 121 on either side of the V-shaped bottom wall of the hopper. The retort tubes are each heated by a 150,000 btu retort tube propane burner. The burners are thermostatically controlled and regulated at 10 psi. The burners utilized commercially available ignition systems, such as a 12 volt DC electronic igniter. The gas burner is preferably provided with a safety shut-off on loss of flame or excessive temperature. The commercially available burner, ignition and safety shut-off system for the retort tubes can be obtained from H. D. Industries, Inc., of Jacksonville, Tex. The commercially available burner has two stages, ignites on 10 ounces of pressure and operates at 10 psi. The retort tubes are used to supply dry, radiant heat to the bottom wall of the hopper compartment.

As shown in FIGS. 6 and 7, each retort tube 133, 135 forms a single pass loop which has a burner 137, 139 installed at one extent thereof and which communicates with an exhaust conduit such as exhaust stacks 141, 143 at an opposite extent thereof (FIG. 6). As best seen in FIG. 6, each retort tube 133, 135 is provided in the shape of an inclined U which is arranged in a plane which is generally parallel to a selected one of the oppositely extending, insulated bottom wall portions (123, 125 in FIG. 7) of the heating chamber 121. Each retort tube 133, 135 thus has a pair of outlets to the exterior of the tank. One of the outlets has the burner mounted therein while the other of the outlets communicates with the exhaust stacks 141, 143 as an exhaust conduit.

Each U-shaped retort tube includes a first leg 145 (FIG. 6) which contains the burner 139 and an oppositely extending second leg 147 which leads to the exhaust stack 143. The two legs 145, 147 are connected by a curved, loop portion 149. As shown in FIG. 7, the heating chamber 121 can also be provided with an electric emersion type heater 151. As best seen in FIG. 7, the heating chamber 121 further includes a pair a heat deflectors 153, 155 which are mounted in proximity to the screw conveyor 127 of the hopper. Each heat deflector is arranged to extend along a first leg of a respective retort tube to partially shield the region of the screw conveyor from the dry heat source.

As briefly mentioned, the asphalt dispensing apparatus shown in FIGS. 6 and 74, as well as the is device of the invention, is most preferably intended to be truck mounted on the bed of a suitable road worthy vehicle. The device could also be a trailer mounted portable device with the device being mounted on the bed of a trailer which would be hauled by a suitable vehicle. The truck or trailer would serve as a portable base for transporting the body 101 to a repair site for repairing a pothole in an asphalt pavement.

While the device shown in FIGS. 6 and 7 works well for its intended purpose, there are some situations in which it is desirable to have a "supplemental heating source" for providing heat during non-working hours of the machine. As has been explained, the previously described "primary heat source" is the heat source that is normally used to heat the asphalt materials in the hopper compartment during normal working hours that the device is in service repairing potholes on a roadway, for example. During non-working hours, for example at night, the primary heat source is shut off and is inactive. In some situations, for example, colder climates or in wintertime use, it may be desirable to provide supplemental heat to the hopper compartment in order to keep the asphalt materials hot and to keep them from seizing up. The present invention is directed to improvements in the heating system used to heat the hopper compartment for maintaining the asphalt repair materials contained therein in a workable state during "non-working hours."

Figure 1:
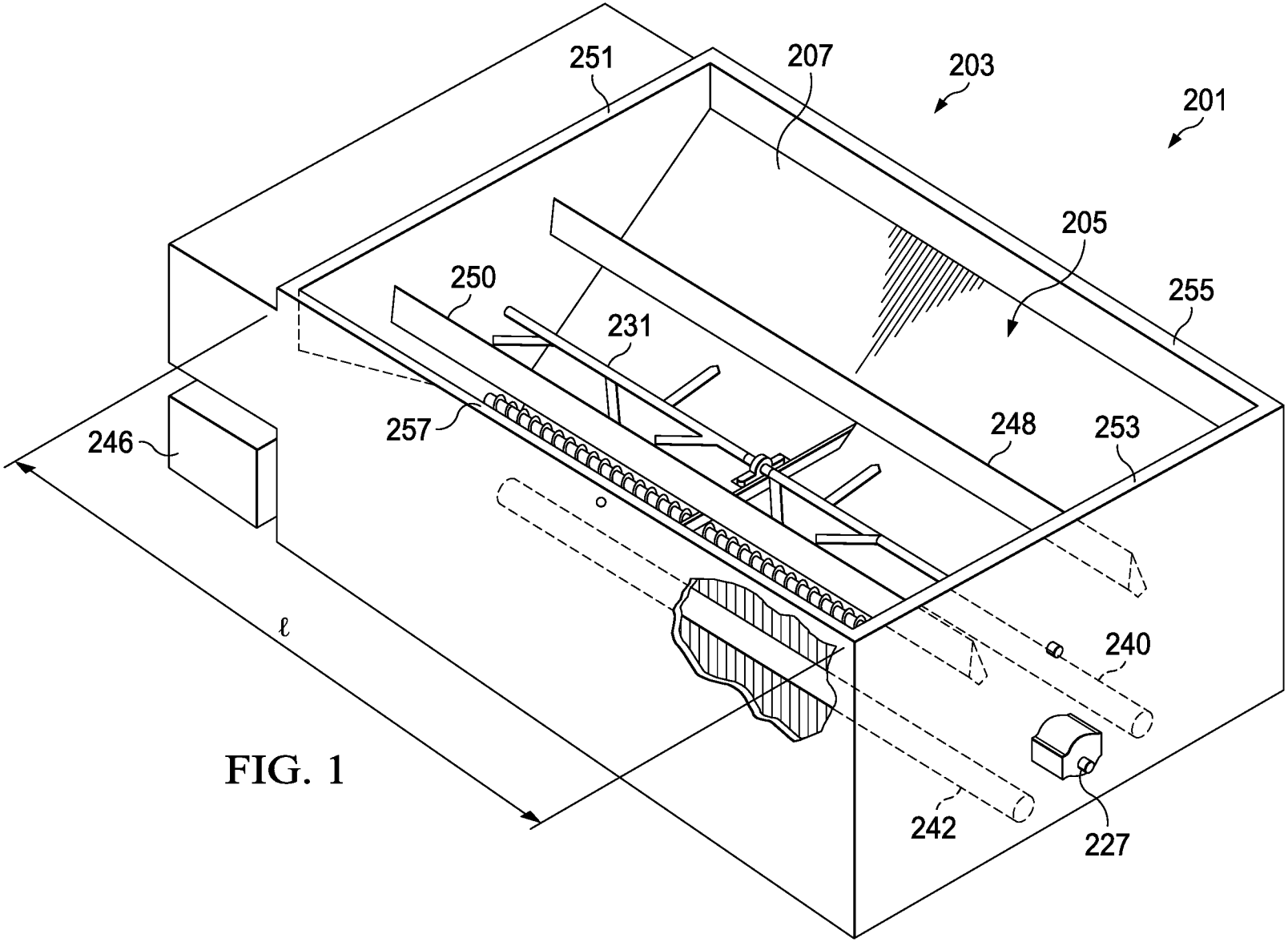
FIG. 1 is a perspective view, partly broken away, of the improved asphalt dispensing body of the invention.
Figure 2:
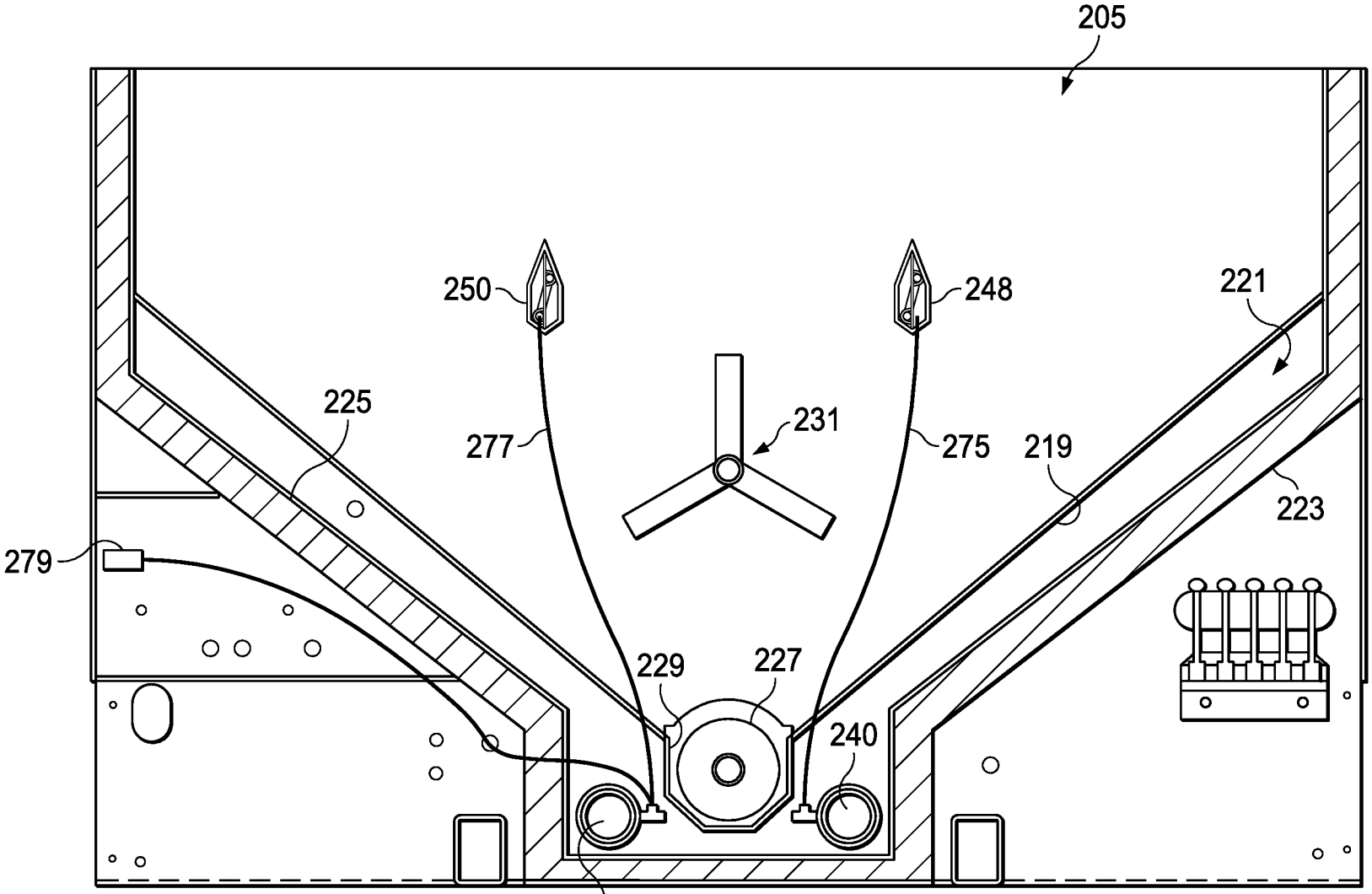
FIG. 2 is an end, partial cross-sectional view of the improved device of FIG. 1.

Turning now to FIGS. 1 and 2, there is shown the improved asphalt dispensing apparatus of the invention, designated generally as 201. The device shown in FIGS. 1 and 2 has many of the same general components as the previously described prior art device of FIGS. 3 and 4, and the corresponding parts will be numbered similarly, generally incremented by 100 in each case. Thus, the improved device includes a body 203 which is adapted to be mounted on a portable base. The body has a hopper compartment 205 (FIG. 1) with a V-shaped bottom wall 207 for transporting asphalt mix materials. As best seen in FIG. 2, the V-shaped bottom wall of the hopper compartment forms an upper, uninsulated common wall 219 of a V-shaped heating chamber 221. The V-shaped heating chamber 221 is thus located below the hopper compartment 205 with the V-shaped bottom wall of the hopper compartment defining an upper extent of the heating chamber 221. The heating chamber also has oppositely extending, insulated bottom wall portions 223, 225, as shown in FIG. 2. The hopper is fully insulated with 2" industrial, high temperature 12R factor insulation encased in a double steel jacket. The V-shaped bottom wall of the hopper compartment thus forms an upper, uninsulated common wall of the heating chamber, the heating chamber having an insulated bottom wall and insulated side walls, as described.

As shown in FIGS. 1 and 2, the body 203 of the portable device is also equipped with an auger or screw conveyor 227 which is mounted in the bottom region 229 of the hopper which forms a trough-like opening extending longitudinally along the bottom wall thereof. As previously described, the screw conveyor 227 is used to dispense asphalt mix materials contained within the hopper. An agitator means, such as paddle shaft 231 is located above the screw conveyor 227 in the hopper compartment 215 for agitating the hopper materials contained therein. The screw conveyor can be, for example, 10 feet long by 6 inches diameter progressive screw conveyor with hard surfaced flights welded continuously on 2 inch scheduled 80 steel pipe and is ball bearing mounted. The conveyor is driven by a 9200 in.lb. torque variable speed hydraulic motor with forward and reverse. It is used to feed a delivery chute (not shown) with 120° of pivot. The paddle shaft 231 is used to break up asphalt due to vibratory compaction. In one embodiment, it is a schedule 160 shaft with 12 spikes and is ball bearing mounted and driven by a 9,200 in.lb. torque variable speed hydraulic motor with forward and reverse.

The apparatus of the invention may include a separate emulsion or liquid asphalt tank (not shown) mounted on the portable base for transporting and dispensing liquid asphalt type materials used to dress a pothole prior to dispensing the asphalt mix materials from the hopper. The separate liquid asphalt tank could take the form of, for example, the tank described in issued U.S. Pat. No. 4,944,632, supra, assigned to the assignee of the present invention. That tank is provided with an internal circulation system for maintaining liquid tack oils in an emulsified state.

While the primary heat source used with the version of the asphalt dispensing machine shown in FIGS. 6 and 7 was propane heated retort tubes, the primary heat source shown in the device of FIGS. 1 and 2 is an ails-electric heat source associated with the liquid filled heating chamber 221 for heating the chamber and for transferring heat to the hopper compartment 205 through the hopper bottom wall 207. As shown in FIGS. 1 and 2, the all-electric heat source preferably comprises a pair of oppositely arranged electric heaters 240, 242, located within the heating chamber 221 on either side of the V-shaped bottom wall of the hopper. The electric heaters are powered by an electric generator (246 in FIG. 1) also mounted on the body of the device, whereby the electric heaters can be used to supply heat to the bottom wall of the hopper to maintain the asphalt mix materials in a workable state. In this design of the asphalt dispensing device, there are no retort tubes. Instead, the electric heaters are enclosed within the 130 gallon heating chamber once the chamber is filled with heat transfer oil. The heating chamber 221 is then sealed up.

During working hours, the 130 gallon heat transfer oil heating chamber is heated by the two 208 to 240 volt AC single phase electric resistance heaters powered by a 50 amp, 12,000 watt, PTO hydraulic driven on-board electric generator. This exemplary system is capable of heating asphalt materials from 0° to 300° F. The electric generator could also be run off an auxiliary pony motor, or the like.

The improved supplementary heat source which is used to heat the asphalt materials in the hopper compartment during non-working hours will now be described. With reference to FIGS. 1-5, the supplement heat source comprises one or more electric electric heat riser tubes. In the preferred design, there are two electric heat riser tubes 248, 250 which extend longitudinally within the interior of the hopper compartment 205 and which are selected to provide "low density heat" to prevent asphalt materials within the hopper compartment from overheating and burning or deteriorating during periods of supplemental heating.

The term "low density heat" is used in the general sense that this ten n is used, for example, in the water heater industry. In other words, electric storage water heaters use electrical resistance to raise the temperature of one or more heating elements mounted inside the water tank. These elements are categorized as "low-density" or "high-density", based on their design. The "density" refers to the amount of wattage per square inch of surface area. As an example, a heater element with 10 square inches of surface area, rated for 1,500 watts, would conduct 150 watts per square inch when in use. By comparison, a 1,500 watt element with only 7.5 square inches of surface area would be a higher density element, conducting 200 watts per square inch. Low-density elements have more surface area than high-density elements, with comparable wattage.

The terms "high-density" and "low-density" as applied to electric heating elements of the type under consideration thus simply refers to how much wattage the element uses in comparison to its surface area or its size. An element with low density uses a lower temperature to operate. A unit with higher density uses a higher temperature to operate. In the preferred embodiment to be more fully described, the electric heating rods which are inserted within the electric heat riser tubes are 220 volt electric heating rods. They each have an 800 watt rating to provide low density, slow heat to prevent the asphalt materials in the hopper compartment for cooking on the exterior surfaces of the electric heat riser tubes in use. In the example shown, the electric heat riser tubes are approximately 108 inches long and the electric heating rods are approximately 96 inches long. With this particular configuration, the 220 volt electric heat riser tubes can supply low density, slow heat to the electric heat riser tubes in the range from 250° F. to 275° F. to keep the asphalt in the hopper compartment hot but without overheating the asphalt.

With reference again to FIG. 1, it can be seen that the hopper compartment 205 has a front wall 251, a rear wall 253 and opposing side walls 255, 257, the front and rear walls defining a chamber length ("1" in FIG. 1) therebetween. The pair of electric heat riser tubes 248, 250, are located in a generally horizontal plane which extends between the front and rear walls 251, 253, above the plane of the agitator shalt 231, the electric heat riser tubes extending generally parallel to one another on either side of the agitator shaft 231 for a majority of the chamber length. The electric heat riser tubes are installed approximately two thirds of the way up the internal height of the hopper compartment and are effective to keep asphalt materials in the hopper compartment hot during non-working hours of the device when plugged into a 220 volt electric supply outlet.

Figure 3:
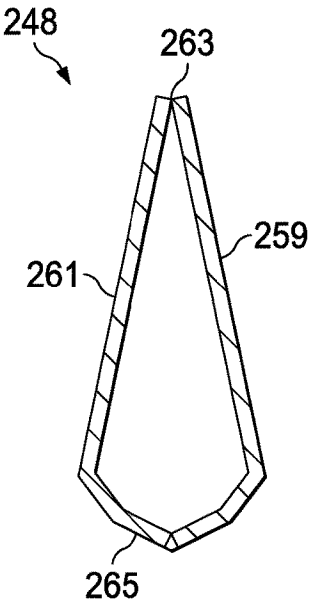
FIG. 3 is an end, sectional view of one of the electric heat riser tubes which is used to house an electric heating rod and which makes up a supplemental heat source for the device of the invention.

With reference now to FIG. 3, it will be seen that the individual electric heat riser tubes, such tube 248, are generally tear drop shaped in cross section. As will be appreciated from FIGS. 1 and 3, the electric heat riser tubes comprise an external plate-like structure with opposing longitudinal sides 259, 261, which diverge from an upper apex 263 downwardly toward a curved bottom region 265 of the heat tubes. The heat riser tube 248 shown in FIG. 3 is made of 3/16 inch steel plate. It is approximately 6.01 inches high ("h" in FIG. 3) and 2.09 inches wide ("w" in FIG. 3. As has been mentioned, the riser tube of FIG. 3 is approximately 108 inches in length.

Figure 4A:
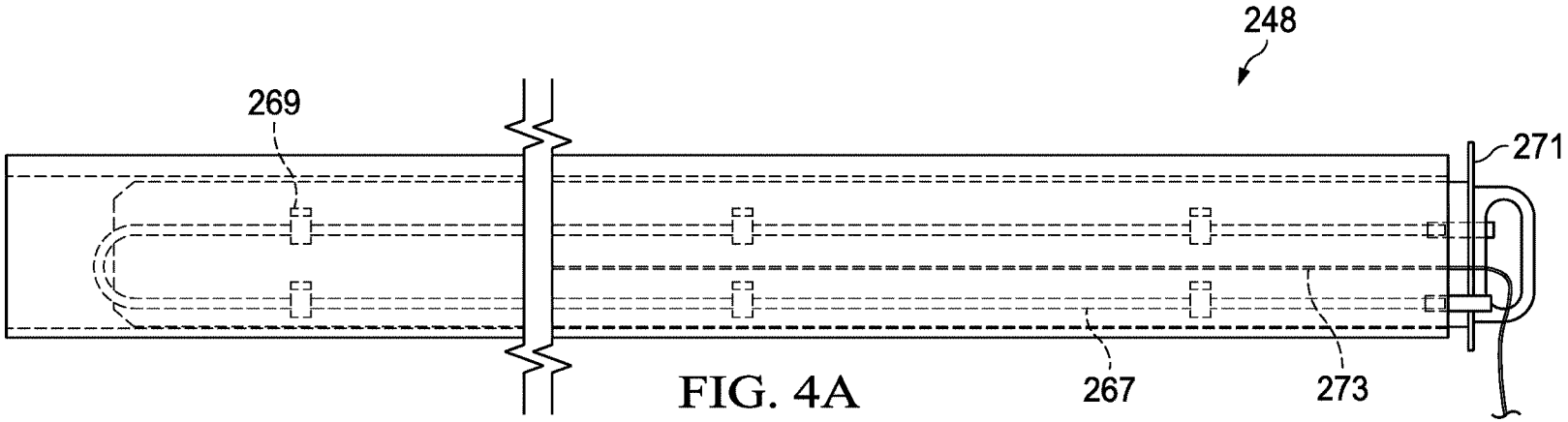
FIG. 4A is a side view, partly in section, of one of tale electric heat riser tubes of the invention, showing the internal components thereof.
Figure 4B:
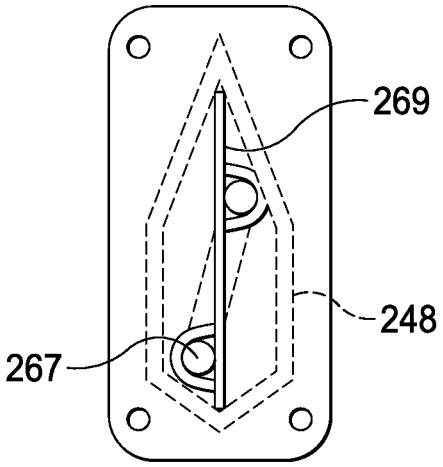
FIG. 4B is an end view of the heat riser tube of FIG. 4A.

As perhaps best seen in FIG. 4, the electric heat riser tubes 248, 250, and are used to contain electric heating elements, such as the electric resistance heating rod 267 in FIG. 4. The electric heating rod 267 in FIG. 4 is U-shaped with two parallel legs which run the substantial length of the particular heat riser tube. The rod can be mounted in any suitable fashion within the heat riser tube, such as by mounting clamps 269, the clamps being situated at spaced locations along the length of the U-shaped rod 267. The interior of the heat riser tube 248 is sealed at one end and closed off at the opposite end by a mounting flange 271 to allow access to the interior of the riser tube for maintenance of the heating rods. Preferably, the electric heating rod 267 is also provided with a built-in thermocouple which runs to the same thermostat that controls the 220 volt electric heaters 240, 242 that constitute the primary heat source for the hopper compartment. FIG. 2 shows the electrical control lines 275, 277, that supply electric power to the heating rods and which convey control information form the heating rod thermocouples to the device thermostat 279.

Figure 5:
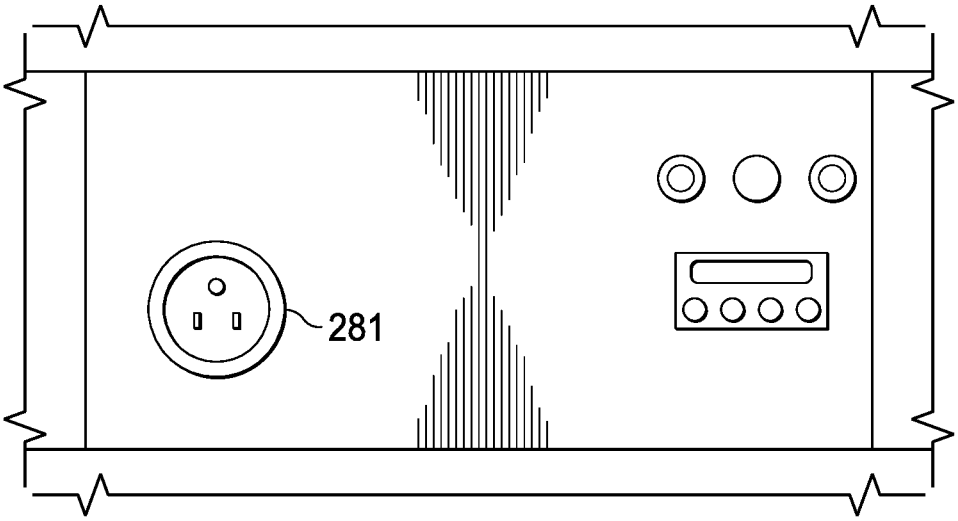
FIG. 5 is simplified view of the side control panel used with the device of the invention, showing the electric power plug for supplying electric power to the electric heating rods of the electric heat riser tubes which make up the supplemental heat source.

As shown in simplified fashion in FIG. 5, the electric heating rods 267 are powered by plugging them into a 220 volt electric supply outlet 281 during non-working hours. In this case, the outlet is on the control panel of the truck mounted dispensing body.

One preferred version of the asphalt dispensing machine of the invention has been described in FIGS. 1 and 2 as having the previously described all-electric primary heating source comprised of the 220 volt electric heaters 240, 242. However, it should be apparent that the heat riser tube features of the invention could also be used in dispensing machines heated by other primary heat sources commonly used in the industry. For example, the primary heat source could be selected from the group consisting of an LP gas heating source, a CNG gas heating source, an electric heating source and a diesel fired heating source, to name several conventional sources.

The operation of the version of the asphalt dispensing apparatus of FIGS. 1 and 2 will now be briefly described. The heat transfer oil in the heating chamber 221 is heated by the two electric 220 volt resistance heaters 240, 242, which, in turn, heat the asphalt mix in the hopper compartment 205. The heat transfer oil in the heating chamber 221 is sealed off and does not intermix with the emulsion or tack oil contained in its separate tank. At the job site, suitable hydraulic tools are connected to outputs from the hopper compartment and the emulsion tank so that repairs can be quickly accomplished. Spray equipment such as a conventional wand can be connected to a discharge valve for dispensing liquid asphalts or emulsions to seal and tack the dressed cavity. The screw conveyor 227 is then actuated to dispense asphalt mix materials from the hopper compartment 205 through the discharge chute into the cavity as required. The filled cavity can then be compacted with a hydraulic tamper to complete the job.

In addition to the previously described apparatus used in the practice of the invention, there is also provided an improved method for repairing a pothole in an asphalt pavement, comprising the steps of:

providing a body on a portable base for transporting the body to a repair site, the body being equipped with a hopper compartment with a V-shaped bottom wall for transporting asphalt mix materials and a generally V-shaped heating chamber located below the hopper compartment, the V-shaped bottom wall of the hopper compartment defining an upper extent of the heating chamber; providing a screw conveyor mounted in the bottom of the hopper compartment for dispensing asphalt mix materials therefrom;

providing a paddle shaft located above the screw conveyor in the hopper compartment for agitating the hopper materials;

providing a primary heat source associated with the heating chamber for heating the chamber and for transferring heat to the hopper compartment through the hopper bottom wall to maintain the asphalt mix materials in a workable state during normal working hours of the machine;

providing a supplemental heat source located within the hopper compartment for heating the hopper compartment during non-working hours, the supplement heat source comprising one or more electric heat riser tubes which extend longitudinally within au interior of the hopper compartment and which are selected to provide low density heat to prevent asphalt materials within the hopper compartment from overheating and burning or deteriorating during periods of supplemental heating:

dispensing asphalt mix materials from the hopper compartment to fill and repair a pothole during normal working hours of the device; and turning off the primary heat source for the hopper compartment during non-working hours and turning on the supplemental heat source to heat asphalt materials in the hopper compartment during the non-working hours.

An invention has been provided with several advantages. The device is simpler in design and more economical to manufacture than some of the prior art devices of the same general type. In the case of the all-electric version of the device, the heat system utilized heats more efficiently in some outside environments. Once the electric heaters get the hopper compartment hot, it stays hot for an extended period of time. The use of the submerged electric heaters in the sealed heating chamber has been found to increase the life expectancy of an associated electric generator by 50% over prior art systems. Since the heating chamber is sealed, it is only infrequently necessary to replenish the heat transfer medium or maintain such medium. In both the all-electric machine and in other machines having alternate primary heat sources, such as LP gas, and the like, the supplemental heating system provides heat to the hopper compartment during non-working hours when the primary heat source is turned off. The described electric heating rods and heat riser tube arrangement can effectively supply low density, slow heat to the electric heat riser tubes in the range from 250° F. to 275° F. to prevent asphalt materials in the hopper compartment from being overheated during the period of time that the electric heat riser tubes are employed.

While the invention has been shown in several of its forms, it is not thus limited but is susceptible to various changes and modifications without departing from the spirit thereof, as described in the claims which follow.

What is claimed is:

1. A portable device for transporting asphalt repair materials for use in repairing potholes in asphalt pavements, the device comprising:

a body adapted to be mounted on a portable base for transporting the body to a repair site, the body having a hopper compartment with a V-shaped bottom wall for transporting asphalt mix materials and a generally V-shaped heating chamber located below the hopper compartment, the V-shaped bottom wall of the hopper compartment defining an upper extent of the heating chamber;

an auger mounted in the bottom of the hopper compartment for dispensing asphalt mix materials therefrom;

an agitator shah located above the auger in the hopper compartment for agitating the hopper materials;

a primary heat source associated with the heating chamber for heating the chamber and for transferring heat to the hopper compartment through the hopper bottom wall for heating the hopper compartment during normal working hours;

a supplemental heat source located within the hopper compartment for heating the hopper compartment during non-working hours, the supplement heat source comprising one or more electric heat riser tubes which extend longitudinally within an interior of the hopper compartment and which are selected to provide low density heat to prevent asphalt materials within the hopper compartment from overheating and burning or deteriorating during periods of supplemental heating;

wherein the primary heat source is selected from the group consisting of an LP gas heating source, a CNG gas heating source, an electric heating source and a diesel fired heating source;

wherein the hopper compartment has a front wall, a rear wall and opposing side walls, the front and rear walls defining a chamber length therebetween, and wherein a pair of electric heat riser tubes are located in a generally horizontal plane which extends between the front and rear walls above the plane of the agitator shaft, the electric heat riser tubes extending generally parallel to one another on either side of the agitator shaft for a majority of the chamber length;

wherein the electric heat riser tubes are tear drop shaped in cross section and are used to contain electric heating rods which are plugged into a 220 volt electric supply outlet during non-working hours;

wherein the electric heating rods are of sufficient wattage to supply low density slow heat to the electric heat riser tubes in the range from 250° F. to 275° F. to prevent asphalt materials in the hopper compartment from being overheated.

2. A portable device for transporting asphalt repair materials for use in repairing potholes in asphalt pavements, the device comprising:

a body adapted to be mounted on a portable base for transporting the body to a repair site, the body having hopper compartment with a V-shaped bottom wall for transporting asphalt mix materials and generally V-shaped heating chamber located below the hopper compartment, the V-shaped bottom wall of the hopper compartment defining an upper extent of the heating chamber;

an auger mounted in the bottom of the hopper compartment for dispensing asphalt mix materials therefrom;

an agitator shaft located above the auger in the hopper compartment for agitating the hopper materials;

a primary heat source associated with the heating chamber for heating the chamber and for transferring heat to the hopper compartment through the hopper bottom wall for heating the hopper compartment during normal working hours;

a supplemental heat source located within the hopper compartment for heating the hopper compartment during non-working hours, the supplement heat source comprising one or more electric heat riser tubes which extend longitudinally within an interior of the hopper compartment and which are selected to provide low density heat to prevent asphalt materials within the hopper compartment from overheating and burning or deteriorating during periods of supplemental heating;

wherein the primary heat source is selected from the group consisting of an LP gas heating source, a CNG gas heating source, an electric heating source and a diesel fired heating source;

wherein the hopper compartment has a front wall, a rear wall and opposing side walls, the front and rear walls defining a chamber length therebetween, and wherein a pair of electric heat riser tubes are located in a generally horizontal plane which extends between the front and rear walls above the plane of the agitator shaft, the electric heat riser tubes extending generally parallel to one another on either side of the agitator shaft for a majority of the chamber length;

wherein the electric heat riser tubes are tear drop shaped in cross section and are used to contain electric heating rods which are plugged into a 220 volt electric supply outlet during non-working hours; and wherein the heating rods are 800 watt electric rods which are selected to supply low density slow heat to the electric heat riser tubes in the range from 250° F. to 275° F. to prevent asphalt materials in the hopper compartment from being overheated.

3. The device of claim 2, wherein the heating rods within the riser tubes are approximately 96 inches long and the riser tubes themselves are approximately 108 inches long.

4. The device of claim 3, wherein the electric heat riser tubes comprise an external structure with opposing longitudinal sides which diverge from an upper apex downwardly toward a curved bottom region of the heat tubes.

5. The device of claim 4, wherein the electric heat riser tubes are installed approximately two thirds of the way up an internal height of the hopper compartment and are effective to keep asphalt materials in the hopper compartment hot during non-working hours of the device when plugged into a 220 volt electric supply outlet.

6. The device of claim 5, wherein the electric heating rods in the electric heat riser tubes have a built-in thermocouple.

7. The device of claim 1, wherein the V-shaped bottom wall of the hopper compartment forms an upper, uninsulated common wall of the heating chamber, the heating chamber having an insulated bottom wall and insulated side walls.

8. The device of claim 7, wherein the heating chamber is a sealed heat transfer oil chamber and the heat transfer oil chamber is heated by one of the primary heat sources of the device.

* * * * *